United States Patent [19]

Bergman

[11] Patent Number: 4,511,464

[45] Date of Patent: Apr. 16, 1985

[54] 1,3-OXATHIOLANE-2-THIONES AS SULFIDE MINERAL COLLECTORS IN FROTH FLOTATION

[75] Inventor: Roger W. Bergman, Midland, Mich.

[73] Assignee: The Dow Chemical Company, Midland, Mich.

[21] Appl. No.: 516,082

[22] Filed: Jul. 22, 1983

[51] Int. Cl.[3] ..... B03D 1/14

[52] U.S. Cl. ..... 209/166; 209/167; 252/61; 549/30; 549/36

[58] Field of Search ..... 549/30, 36; 209/166, 209/167; 252/61

[56] References Cited

U.S. PATENT DOCUMENTS

| | | | |
|---|---|---|---|
| 1,801,318 | 4/1931 | Moses et al. . | |
| 1,801,319 | 4/1931 | Moses et al. . | |
| 2,248,912 | 7/1941 | Coltof | 209/166 |
| 2,312,414 | 3/1943 | Jayne et al. . | |
| 2,644,580 | 7/1953 | Robbins et al. . | |
| 2,662,899 | 12/1953 | Bashour | 549/36 |
| 2,701,253 | 2/1955 | Jones et al. | 209/166 |
| 3,409,635 | 11/1968 | Benneville et al. . | |
| 3,590,997 | 7/1971 | Harris et al. . | |
| 3,787,471 | 1/1974 | Harris et al. . | |
| 4,316,797 | 2/1982 | Parlman | 209/166 |
| 4,341,626 | 7/1982 | Dauplaise et al. | 209/167 |

FOREIGN PATENT DOCUMENTS

| | | | |
|---|---|---|---|
| 496290 | 11/1938 | United Kingdom | 549/36 |
| 1135798 | 12/1968 | United Kingdom | 549/30 |

OTHER PUBLICATIONS

Kirk Othmer Encyclopedia of Chem. Technology, 2nd edition, vol. 22, 427, (1970).

Japanese Patent 68-24,176, (Chem. Abs. 70:87794d).

Belgium Patent 648653, (Chem. Abs. 63:13267h).

*Primary Examiner*—Bernard Nozick

*Attorney, Agent, or Firm*—Norman L. Sims

[57] ABSTRACT

The invention is a process of concentrating sulfide ores, which comprises subjecting a sulfide ore, in the form of a pulp, to a flotation process in the presence of a flotation collector for the sulfides comprising a 1,3-oxathiolane-2-thione or a 1,3-dithiolane-2-thione.

12 Claims, No Drawings

1,3-OXATHIOLANE-2-THIONES AS SULFIDE MINERAL COLLECTORS IN FROTH FLOTATION

BACKGROUND OF THE INVENTION

This invention relates to the concentration of sulfide mineral ores by froth flotation using 1,3-oxathiolane-2-thiones as collectors.

Flotation is a process of treating a mixture of finely divided mineral solids, e.g., a pulverulent ore, suspended in a liquid whereby a portion of such solids are separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

Various flotation agents have been admixed with the suspension to improve the frothing process. Such added agents are classed according to the function to be performed: collectors, for sulfide minerals including xanthates, thionocarbamates and the like; frothers which impart the property of forming a stable froth, e.g., natural oils such as pine oil and eucalyptus oil, modifiers such as activators to induce flotation in the presence of a collector, e.g., copper sulfate; depressants, e.g., sodium cyanide, which tend to prevent a collector from functioning as such on a mineral which it is desired to retain in the liquid, and thereby discourage a substance from being carried up and forming a part of the froth; pH regulators to produce optimum metallurgical results, e.g., lime, soda ash and the like. U.S. Pat. No. 3,464,551 discloses using dialkyl dithiocarbamates

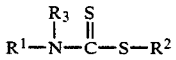

as flotation collectors; U.S. Pat. No. 3,590,996 describes flotation of sulfide ores using certain thionocarbamates.

It is of importance to bear in mind that additives of the above type are selected for use according to the nature of the ore, the mineral sought to be recovered, and the other additaments which are to be used in combination therewith.

An understanding of the phenomena which makes flotation a particularly valuable industrial operation is not essential to the practice of the present invention. They appear, however, to be largely associated with selective affinity of the surface of particulated solids, suspended in a liquid containing entrapped gas, for the liquid on the one hand, the gas on the other.

The flotation principle is applied in a number of mineral separation processes among which is the selective separation of such minerals as sulfide copper minerals, sulfide zinc minerals, sulfide molybdenum minerals and others from sulfide iron minerals.

Among commonly used collectors are the xanthates and the dithiophosphates. These collectors must be dried after preparation or shipped in solution which creates handling problems. Such collectors are relatively inexpensive but their activity as collectors is not as good as some other collectors.

Another class of commonly used collectors is the thionocarbamates. The preparation of these compounds normally requires a three-step synthesis, wherein salts and mercaptans are by-products. Such compounds are relatively expensive to prepare but have good activity. What is needed is a collector for sulfide ores which can be prepared in a simple synthesis scheme without the preparation of salt or mercaptan by-products. Further needed is a collector which does not necessitate drying or shipping in solution. What is further needed is a collector which is relatively inexpensive to prepare with good collector activity.

SUMMARY OF THE INVENTION

The invention is a process of concentrating sulfide ores, which comprises subjecting a sulfide ore, in the form of a pulp, to a flotation process in the presence of a flotation collector for the sulfides wherein the flotation collector comprises a 1,3-oxathiolane-2-thione or a 1,3-dithiolane-2-thione.

The 1,3-oxathiolane-2-thiones or a 1,3-dithiolane-2-thione can be prepared relatively inexpensively by a simple synthesis scheme which does not prepare salt or mercaptan by-products. Further, the compounds do not need to be dried or shipped in water. Surprisingly, these compounds show much better activity than the xanthates or dithiophosphates.

DETAILED DESCRIPTION OF THE INVENTION

The 1,3-oxathiolane-2-thiones or 1,3-dithiolane-2-thiones (hereinafter referred to as cyclic thiones) of this invention include those which correspond to the formulas

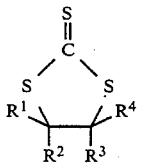

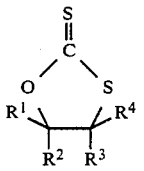

wherein $R^1$, $R^2$, $R^3$ and $R^4$ are separately in each occurrence hydrogen, an unsubstituted hydrocarbyl group or a hydrocarbyl group substituted with a halo, carbonylalkoxy, alkoxy, thioalkyl, thiol, cyano, hydroxyl or nitro group.

Hydrocarbyl means herein an organic radical containing between one and twenty carbon atoms to which are bonded hydrogen atoms. Included are the following groups: alkyl, alkenyl, alkynyl, cycloalkyl, cycloalkenyl, aryl, alkaryl or aralkyl.

The term aryl refers herein to biaryl, phenyl, naphthyl, phenanthranyl and anthranyl. Alkaryl refers herein to an alkyl-, alkenyl- or alkynyl-substituted aryl substituent wherein aryl is as defined hereinbefore. Aralkyl means herein an alkyl, alkenyl or alkynyl substituent substituted with an aryl group, wherein aryl is as defined hereinbefore. Alkyl includes straight and branched chain methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups. Alkenyl includes straight and branched chain ethenyl, propenyl, butenyl, pentenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl and eicosenyl groups. Alkynyl groups include straight and branched chain ethynyl, propynyl, butynyl, pentynyl, hexynyl, heptynyl, octynyl, nonynyl, decynyl, undecynyl, dodecynyl, tridecynyl, tetradecynyl, pentadecynyl, hexadecynyl, heptadecynyl, octadecynyl, nonadecynyl and eicosynyl groups.

Cycloalkyl refers to an alkyl group containing one, two, three or more cyclic rings, including cyclopropyl, cyclobutyl, cyclopentyl, cyclohexyl, cycloheptyl, cyclooctyl, cyclononyl, cyclodecyl, cycloundecyl, cyclododecyl, cyclotridecyl, cyclotetradecyl, cyclopentadecyl, cyclohexadecyl, cycloheptadecyl, cyclooctadecyl, cyclononadecyl, cycloeicosyl, bicyclopropyl, bicyclobutyl, bicyclopentyl, bicyclohexyl, bicycloheptyl, bicyclooctyl, bicyclononyl, bicyclodecyl, tricyclopropyl, tricyclobutyl, tricyclopentyl, tricyclohexyl groups and groups containing two or more of the cycloalkyl groups named hereinbefore. Cycloalkenyl refers to mono-, di- and polycyclic groups containing one or more double bonds including cyclopropenyl, cyclobutenyl, cyclopentenyl, cyclohexenyl, cycloheptenyl, cyclooctenyl, cyclononenyl, cyclodecenyl, cycloundecenyl, cyclododecenyl, cyclotridecenyl, cyclotetradecenyl, cyclopentadecenyl, cyclohexadecenyl, cycloheptadecenyl, cyclooctadecenyl, cyclononadecenyl, cycloeicosenyl, bicyclopropenyl, bicyclobutenyl, bicyclopentenyl, bicycloheptenyl, bicyclooctenyl, bicyclononenyl, bicyclopentenyl, tricyclopropenyl, tricyclobutenyl, tricyclopentenyl, tricyclohexenyl groups. Cycloalkenyl also refers to the above-named cycloalkenyl groups wherein two or more double bonds are present, for example, cyclobutadienyl, cyclopentadienyl and cyclohexadienyl groups.

In the above formula $R^1$ preferably $C_{1-20}$ hydrocarbyl. $R_1$ is more preferably $C_{1-20}$ alkyl or $C_{1-20}$ aryl, even more preferably $C_{2-10}$ alkyl, and most preferably $C_{4-6}$ alkyl. $R^2$, $R^3$ and $R^4$ are preferably $C_{1-20}$ hydrocarbyl or hydrogen, and more preferably hydrogen.

Among the compounds within the scope of this invention are the following: 1,3-oxathiolane-2-thione, 5-methyl-1,3-oxathiolane-2-thione, 5-ethyl-1,3-oxathiolane-2-thione, 5-propyl-1,3-oxathiolane-2-thione, 5-butyl-1,3-oxathiolane-2-thione, 5-pentyl-1,3-oxathiolane-2-thione, 5-hexyl-1,3-oxathiolane-2-thione, 5-heptyl-1,3-oxathiolane-2-thione, 5-octyl-1,3-oxathiolane-2-thione, 5-nonyl-1,3-oxathiolane-2-thione, 5-decyl-1,3-oxathiolane-2-thione, 5,5-dimethyl-1,3-oxathiolane-2-thione, 5,5-diethyl-1,3-oxathiolane-2-thione, 5,5-dipropyl-1,3-oxathiolane-2-thione, 5,5-dibutyl-1,3-oxathiolane-2-thione, 5,5-dipentyl-1,3-oxathiolane-2-thione, 5,5-dihexyl-1,3-oxathiolane-2-thione, 5,5-diheptyl-1,3-oxathiolane-2-thione, 5,5-dioctyl-1,3-oxathiolane-2-thione, 5,5-dinonyl-1,3-oxathiolane-2-thione, 5,5-didecyl-1,3-oxathiolane-2-thione, 5-methyl-5-ethyl-1,3-oxathiolane-2-thione, 5-methyl-5-propyl-1,3-oxathiolane-2-thione, 5-methyl-5-butyl-1,3-oxathiolane-2-thione, 5-methyl-5-pentyl-1,3-oxathiolane-2-thione, 5-methyl-5-hexyl-1,3-oxathiolane-2-thione, 5-ethyl-5-propyl-1,3-oxathiolane-2-thione, 5-ethyl-5-butyl-1,3-oxathiolane-2-thione, 5-ethyl-5-pentyl-1,3-oxathiolane-2-thione, 5-ethyl-5-hexyl-1,3-oxathiolane-2-thione, 5-propyl-5-butyl-1,3-oxathiolane-2-thione, 5-propyl-5-pentyl-1,3-oxathiolane-2-thione, 5-propyl-5-hexyl-1,3-oxathiolane-2-thione, 5-butyl-5-pentyl-1,3-oxathiolane-2-thione, 5-butyl-5-hexyl-1,3-oxathiolane-2-thione, 5-pentyl-5-hexyl-1,3-oxathiolane-2-thione or 5-phenyl-1,3-oxathiolane-2-thione. Preferred 1,3-oxathiolane-2-thiones include 5-butyl-1,3-oxathiolane-2-thione, 5-pentyl-1,3-oxathiolane-2-thione and 5-hexyl-1,3-oxathiolane-2-thione.

Among the 1,3-dithiolane-2-thiones within the scope of this invention are the following: 1,3-dithiolane-2-thione, 5-methyl-1,3-dithiolane-2-thione, 5-ethyl-1,3-dithiolane-2-thione, 5-propyl-1,3-dithiolane-2-thione, 5-butyl1,3-dithiolane-2-thione, 5-pentyl-1,3-dithiolane-2-thione, 5-hexyl-1,3-dithiolane-2-thione, 5-heptyl-1,3-dithiolane-2-thione, 5-octyl-1,3-dithiolane-2-thione, 5-nonyl-1,3-dithiolane-2-thione, 5-decyl-1,3-dithiolane-2-thione, 5,5-dimethyl-1,3-dithiolane-2-thione, 5,5-diethyl-1,3-dithiolane-2-thione, 5,5-dipropyl-1,3-dithiolane-2-thione, 5,5-dibutyl-1,3-dithiolane-2-thione, 5,5-dipentyl-1,3-dithiolane-2-thione, 5,5-dihexyl-1,3-dithiolane-2-thione, 5,5-diheptyl-1,3-dithiolane-2-thione, 5,5-dioctyl-1,3-dithiolane-2-thione, 5,5-dinonyl-1,3-dithiolane-2-thione, 5,5-didecyl-1,3-dithiolane-2-thione, 5-methyl-5-ethyl-1,3-dithiolane-2-thione, 5-methyl-5-propyl-1,3-dithiolane-2-thione, 5-methyl-5-butyl-1,3-dithiolane-2-thione, 5-methyl-5-pentyl-1,3-dithiolane-2-thione, 5-methyl-5-hexyl-1,3-dithiolane-2-thione, 5-ethyl-5-propyl-1,3-dithiolane-2-thione, 5-ethyl-5-butyl-1,3-dithiolane-2-thione, 5-ethyl-5-pentyl-1,3-dithiolane-2-thione, 5-ethyl-5-hexyl-1,3-dithiolane-2-thione, 5-propyl-5-butyl-1,3-dithiolane-2-thione, 5-propyl-5-pentyl-1,3-dithiolane-2-thione, 5-propyl-5-hexyl-1,3-dithiolane-2-thione, 5-butyl-5-pentyl-1,3-dithiolane-2-thione, 5-butyl-5-hexyl-1,3-dithiolane-2-thione, 5-pentyl-5-hexyl-1,3-dithiolane-2-thione or 5-phenyl-1,3-dithiolane-2-thione. Preferred 1,3-dithiolane-2-thiones include 5-butyl-1,3-dithiolane-2-thione, 5-pentyl-1,3-dithiolane-2-thione and 5-hexyl-1,3-dithiolane-2-thione.

The cyclic thiones of this invention demonstrate good recovery and rates of recovery as sulfide mineral collectors in froth flotation processes. Any one of the cyclic thiones within the scope of this invention can be used as collectors. Further, a mixture of two or more of the cyclic thiones could be used.

Examples of sulfide minerals for which these collectors are useful include copper sulfide, zinc sulfide, molybdenum sulfide, cobalt sulfide, nickel sulfide, lead sulfide, arsenic sulfide, antimony sulfide, silver sulfide, chromium sulfide, gold sulfide, platinum sulfide and uranium sulfide. The most preferred sulfide mineral is copper sulfide.

Examples of sulfide ores from which metal sulfides may be concentrated by froth flotation using the cyclic thiones as collectors include copper-bearing ores: covallite (CuS), chalcocite ($Cu_2S$), chalcopyrite ($CuFeS_2$), bornite ($Cu_5FeS_4$), cubanite ($Cu_2SFe_4S_5$), valerite ($Cu_2Fe_4S_7$ or $Cu_3Fe_4S_7$) enargite ($Cu_3(As,Sb)S_4$), tetrahedrite ($Cu_3SbS_2$), tennanite ($Cu_{12}As_4S_{13}$), famatinite ($Cu_3(Sb,As)S_4$), bournonite ($PbCuSbS_3$); lead-bearing ores: galena (PbS); antimony-bearing ores: stilnite ($Sb_2S_4$); zinc-bearing ores: sphalerite (ZnS); silver-bearing ores: argentite ($Ag_2S$), stephanite ($Ag_5SbS_4$); chromium-bearing ores: daubreelite ($FeSCrS_3$); platinum-bearing ores: cooperite ($Pt(AsS)_2$).

The amount of the cyclic thione collectors used is dependent upon the particular collector used, the mineral being concentrated, the size of the ore particles and other conditions. Generally the amount of collector which concentrates the sulfide mineral in the froth is suitable. Preferably between about 0.005 to 0.25 pounds of cyclic thione per ton of ore is used, most preferably between 0.015 and 0.08 pounds of cyclic thione per ton of ore is used.

The use of cyclic thiones as collectors results in a higher rate of recovery and a higher recovery than many of the known collectors for sulfide ores. Preferably the recovery for the mineral sulfide is greater than or equal to 0.80, more preferably 0.90. Preferably, the rate of recovery for the mineral sulfide is greater than or equal to 5.5, more preferably 7.0, and most preferably 8.0. Recovery and rate of recovery are defined hereinafter.

The froth flotation processes in which the cyclic thiones of this invention are used, are those which are well-known in the art. In most of these processes, the use of frothing agents is required.

The cyclic thiones can be used in a mixture with any known collectors. Numerous collectors are known in flotation practice or have been proposed in the technical and patent literature. Generic examples include xanthates, thiocarbamates, dithiophosphates, thiocarbanilide, xanthogen formates, alkylamines, quaternary ammonium compounds, sulfonates and the like. Any collector which is known in the art is suitable for the beneficiation by flotation of a sulfide mineral ore can be used in this invention. Further blends of known collectors can also be used in this invention.

Suitable frothers include some compounds which are also commonly used as collectors such as fatty acids, soaps, and alkyl aryl sulfonates, but the best frothers are those which have a minimum of collecting properties. They are polar-nonpolar molecules of the type $C_5H_{11}OH$, amyl alcohol or $C_{10}H_{17}OH$, the active constituent of the well-known frother pine oil. The aliphatic alcohols used as frothers preferably have chain lengths of 5 to 8 carbon atoms, provided there is sufficient branching in the chain. Alcohols in the 10 to 12 carbon atom range are good frothers. Other examples include polyalkylene glycols, polyalkylene glycol ethers, polyoxyalkylene paraffins and cresylic acids. Blends of frothers may also be used. All frothers which are suitable for beneficiation of mineral ores by froth flotation can be used in this invention.

The cyclic thiones of this invention can be prepared by the processes described in U.S. Pat. No. 3,448,120 and U.S. Pat. No. 3,409,635 incorporated herein by reference.

SPECIFIC EMBODIMENTS

The following examples are included for illustration and do not limit the scope of the invention or claims. Unless otherwise indicated, all parts and percentages are by weight.

In the following examples, the performance of the frothing processes described is shown by giving the rate constant of flotation and the amount of recovery at infinite time. These numbers are calculated by using the formula $$\gamma = R_\infty \left[ 1 - \frac{1 - e^{-kt}}{kt} \right]$$

wherein: $\gamma$ is the amount of mineral recovered at time t, k is the rate constant for the rate of recovery and $R_\infty$ is the calculated amount of the mineral which would be recovered at infinite time. The amount recovered at various times is determined experimentally and the series of values are substituted into the equation to obtain the $R_\infty$ and k. The above formula is explained in "Selection of Chemical Reagents for Flotation" by R. R. Kimpel, Ch. 45, *Mineral Processing Plant Design,* 2nd Ed., pp. 907–934 (1980), Mular and Bhappud Editors, The Society of Mining Engineers, N.Y.

EXPERIMENTAL PROCEDURE

Examples 1 to 7

Several of the 1,3-oxathiolane-2-thiones and prior art collectors are used for the flotation of copper sulfide. The procedure for such flotation is described hereinafter. The results are compiled in Table I.

Procedure:

The flotation cell used is a 6.5×6.5×8-inch plexiglass container which holds approximately 2.8 liters of deionized water, ore, collector and frother. A rotating paddle is provided for skimming the frother from the top of the cell into a collection tray. An air inlet is placed in the bottom of the cell.

A copper sulfide ore from the Inspiration Consolidated Copper Company is preground to −10 mesh. Immediately before floating the ore is ground in a rod mill for an additional period of time to obtain the desired mesh size. The process for this grinding is as follows. Eight rods of one inch each are put in a rod mill along with 1000 g of ore, 0.6 g of lime (to bring the pH to 10.6), 600 g of deionized water, 0.05 lb of collector per ton of ore (0.025 g), and the mixture is ground at 60 rpm for about 25 minutes, until approximately 80 percent of the particles had a size of less than 200 mesh.

Thereafter, the slurry is transferred to the float cell as described hereinbefore. The frother, Dowfroth® 1012 (a polypropylene glycol ether available from The Dow Chemical Company, Midland, Michigan) is added to the cell, 0.08 lb per ton of ore (0.04 g). Deionized water is added to bring the water up to the desired level in the float cell. The mixture in the float cell is stirred at 900 rpm for 2 minutes to condition the ore. After 2 minutes of stirring, the air flow of 9 liters/minute is started, with continued stirring, and a paddle rotation of 10 rpm is started. Further water is added to maintain the water level. The froth from the cell is skimmed by the paddle into a collection tray. The froth skimmed off is collected at intervals of 0.5, 1.5, 3.0, 5.0 and 8.0 minutes. Each sample is dried overnight in a forced air oven at 95° C.

The samples are weighed and analyzed for copper content by plasma emission spectroscopy.

The procedure for the analysis by plasma emission spectroscopy is as follows. Into a 100-cc flask is placed 0.2 to 0.25 g of ore sample (approximately 2.0 g if it is a tailings sample, the ore left in the cell after flotation). To this is added 3.5 cc of concentrated hydrochloric acid and 5.0 cc of concentrated nitric acid. The mixture is heated to boiling and boiled for 25 minutes, and then allowed to cool. To this is added 25 cc of deionized water. The mixture is heated to boiling then allowed to cool. The mixture is filled to the volumetric line. A plasma emission spectrometer (Spectrospan IV) is used to determine the copper level in the solutions prepared. The copper emission line at 2135.98 nm is found to give a linear response with copper concentration. The instrument is standardized by the use of copper solution standards. When the sample solution is aspirated into the plasma, the concentration in ppm of Cu is shown by the instrument by digital display. This ppm of Cu is converted into percent Cu in the original sample by the following equation:

$$\% \text{ Cu in original sample} = \frac{(\text{ppm Cu})\,(10^{-6})\,(100)}{(\text{grams of sample used})} \times 100\%.$$

The percent recovery and rate are calculated by substituting the weight of the copper in each sample and the time each sample was taken into the equation described hereinbefore.

The results are compiled in Table I.

TABLE I

| Example | Collector | Copper R | Copper K | R 8 min[1] | Gangue R | Gangue K |
|---|---|---|---|---|---|---|
| 1 | Z-200[2] | 0.65 | 7.7 | 0.63 | 0.14 | 4.2 |
| 2 | Z-11[3] | 0.55 | 4.3 | 0.54 | 0.03 | 3.7 |
| 3 | Sodium Aerofloat ®[4] | 0.55 | 4.6 | 0.54 | 0.03 | 4.1 |
| 4 | 5-methyl-1,3-oxa-thiolane-2-thione | 0.18 | — | 0.18 | 0.06 | 3.4 |
| 5 | 5-ethyl-1,3-oxa-thiolane-2-thione | 0.65 | 5.9 | 0.59 | 0.14 | 3.0 |
| 6 | 5-butyl-1,3-oxa-thiolane-2-thione | 0.68 | 8.3 | 0.67 | 0.23 | 4.3 |
| 7 | 5-hexyl-1,3-oxa-thiolane-2-thione | 0.69 | 8.2 | 0.68 | 0.17 | 4.1 |

[1]The recovery of mineral after 8 minutes.

[2]Z-200 is $(CH_3)_2CHOC(=S)NHCH_2CH_3$

[3]Z-11 is $(CH_3)_2CHOC(=S)SNa$

[4]Sodium Aerofloat is $(C_2HSO)_2PS(=S)Na$ and is available from American Cyanamid.

Examples 1 to 3 demonstrate the activity of known collectors and are not embodiments of this invention Table I demonstrates that the 1,3-oxathiolane-2-thiones generally give rates that are comparable with the xanthates, dithiophosphates, and the thionocarbamates which are generally considered some of the better sulfide ore collectors.

Examples 8–15

Kennecott ore from the Arthur Mill in Utah was subjected to froth flotation conditions using the procedure described hereinafter. Several known collectors were tested along with the novel cyclic thione collectors of this invention. The results are compiled in Table II.

EXPERIMENTAL PROCEDURE

Examples 8 to 15

The flotation cell used is a container which holds approximately 1.7 liters of deionized water, ore, collector and frother. A rotating double-paddle is provided for skimming the frother from the top of the cell into a collection tray. An air inlet is placed in the bottom of the cell.

Kennecott ore containing copper sulfide from the Arthur Mill in Utah is preground to −10 mesh. Immediately before floating the ore is ground in a rod mill for an additional period of time to obtain the desired mesh size. The process for this grinding is as follows. Eight rods of one inch each are put in a rod mill along with 500 g of ore and 1 g of $NaCO_3$, lime is added to adjust the pH to between 10.0 and 10.2, 333 g of deionized water, the collector is added, and the mixture is ground at 60 rpm for about 5 minutes, until approximately 52 percent of the particles had a size of less than 200 mesh.

Thereafter, the slurry is transferred to the float cell as described hereinbefore. The frother, methyl isobutyl, carbinol 50 μl is added to the cell. Deionized water is added to bring the water up to the desired level in the float cell. The mixture in the float cell is stirred at 1050 rpm for 2 minutes to condition the ore. After 2 minutes of stirring, the air flow of 19 cubic feet/hour is started, with continued stirring, and a paddle rotation of 12 rpm is started. Further water is added to maintain the water level. The froth from the cell is skimmed by the paddle into a collection tray. The froth skimmed off is collected at intervals of 0.5, 1.0, 2.0, 4.0 and 8.0 minutes. Each sample is dried overnight in a forced air oven at about 100° C.

The samples are weighed and analyzed for copper content by plasma emission spectroscopy.

The procedure for the analysis by plasma emission spectroscopy is as follows. Into a 100-cc flask is placed 0.2 to 0.25 g of ore sample (approximately 2.0 g if it is a tailings sample, the ore left in the cell after flotation). To this is added 3.5 cc of concentrated hydrochloric acid and 5.0 cc of concentrated nitric acid. The mixture is heated to boiling and boiled for 25 minutes, and then allowed to cool. To this is added 25 cc of deionized water. The mixture is heated to boiling then allowed to cool. The mixture is filled to the volumetric line. A plasma emission spectrometer (Spectrospan IV) is used to determine the copper level in the solutions prepared. The copper emission line at 2135.98 nm is found to give a linear response with copper concentration. The instrument is standardized by the use of copper solution standards. When the sample solution is aspirated into the plasma, the concentration in ppm of Cu is shown by the instrument by digital display. This ppm of Cu is converted into percent Cu in the original sample by the following equation:

$$\% \text{ Cu in original sample} = \frac{(\text{ppm Cu})\,(10^{-6})\,(100)}{(\text{grams of sample used})} \times 100\%.$$

The percent recovery and rate are calculated by substituting the weight of the copper in each sample and the time each sample was taken into the equation described hereinbefore.

TABLE II

| Example | Collector | Level | Copper R | Copper K | R 8 min[1] | Gangue R | Gangue K |
|---|---|---|---|---|---|---|---|
| 8 | Z-6[2] | 0.02 | 0.91 | 11.5 | 0.91 | 0.106 | 18.8 |

TABLE II-continued

| Example | Collector | Level | Copper R | Copper K | R 8 min[1] | Gangue R | Gangue K |
|---|---|---|---|---|---|---|---|
| 9 | Z-11[3] | 0.02 | 0.90 | 12.4 | 0.90 | 0.093 | 15.2 |
| 10 | A-211[4] | 0.02 | 0.89 | 7.8 | 0.89 | 0.052 | 8.3 |
| 11 | Z-200[5] | 0.02 | 0.91 | 7.3 | 0.90 | 0.091 | 6.8 |
| 12 | Z-200[5] | 0.01 | 0.92 | 6.8 | 0.91 | 0.128 | 10.7 |
| 13 | 5-ethyl-1,3-oxathiolane-2-thione | 0.015 | 0.86 | 5.2 | 0.86 | 0.070 | 18.2 |
| 14 | 5-butyl-1,3-oxathiolane-2-thione | 0.015 | 0.90 | 6.1 | 0.89 | 0.090 | 18.6 |
| 15 | 5-butyl-1,3-oxathiolane-2-thione | 0.015 | 0.92 | 6.9 | 0.91 | 0.108 | 12.9 |

[1]The recovery of mineral after 8 minutes.
[2]Z-6 is potassium amyl xanthate.
[3]X-11 is $(CH_3)_2{-}CHOC(=S)SNa$.
[4]A-211 is diisopropyl dithiophosphate.
[5]Z-200 is $(CH_3)_2CHOC(=S)NHCH_2CH_3$.

Examples 8 to 15 demonstrate that the 1,3-oxathiolane-2-thiones demonstrate a recovery of greater than 85 percent, and that such recovery is comparable to the recoveries demonstrated by present commercial collectors.

What is claimed is:

1. A process of concentrating sulfide ores, which comprises subjecting a metal sulfide ore, in the form of a pulp, to a flotation process in the presence of a flotating amount of a flotation collector for the sulfides wherein the collector comprises a 1,3-oxathiolane-2-thione and recovering the desired metal sulfide in the froth.

2. The process of claim 1 wherein the amount of the 1,3-oxathiolane-2-thione is between about 0.005 and 0.25 pound per ton of ore.

3. The process of claim 1 which further includes the use of a frother.

4. The process of claim 1 wherein the collector further comprises a xanthate, thiocarbamate, dithiophosphate, thiocarbanilide, xanthogen formate, alkylamine, quaternary ammonium compound, a sulfonate or a mixture thereof.

5. The process of claim 1 wherein the collector comprises 1,3-oxathiolane-2-thione, 5-methyl-1,3-oxathiolane-2-thione, 5-ethyl-1,3-oxathiolane-2-thione, 5-propyl-1,3-oxathiolane-2-thione, 5-butyl-1,3-oxathiolane-2-thione, 5-pentyl-1,3-oxathiolane-2-thione, 5-hexyl-1,3-oxathiolane-2-thione, 5-heptyl-1,3-oxathiolane-2-thione, 5-octyl-1,3-oxathiolane-2-thione, 5-nonyl-1,3-oxathiolane-2-thione, 5-decyl-1,3-oxathiolane-2-thione, 5,5-dimethyl-1,3-oxathiolane-2-thione, 5,5-diethyl-1,3-oxathiolane-2-thione, 5,5-dipropyl-1,3-oxathiolane-2-thione, 5,5-dibutyl-1,3-oxathiolane-2-thione, 5,5-dipentyl-1,3-oxathiolane-2-thione, 5,5-dihexyl-1,3-oxathiolane-2-thione, 5,5-diheptyl-1,3-oxathiolane-2-thione, 5,5-dioctyl-1,3-oxathiolane-2-thione, 5,5-dinonyl-1,3-oxathiolane-2-thione, 5,5-didecyl-1,3-oxathiolane-2-thione, 5-methyl-5-ethyl-1,3-oxathiolane-2-thione, 5-methyl-5-propyl-1,3-oxathiolane-2-thione, 5-methyl-5-butyl-1,3-oxathiolane-2-thione, 5-methyl-5-pentyl-1,3-oxathiolane-2thione, 5-methyl-5-hexyl-1,3-oxathiolane-2-thione, 5-ethyl-5-propyl-1,3-oxathiolane-2-thione, 5-ethyl-5-butyl-1,3-oxathiolane-2-thione, 5-ethyl-5-pentyl-1,3-oxathiolane-2-thione, 5-ethyl-5-hexyl-1,3-oxathiolane-2-thione, 5-propyl-5-butyl-1,3-oxathiolane-2-thione, 5-propyl-5-pentyl-1,3-oxathiolane-2-thione, 5-propyl-5-hexyl-1,3-oxathiolane-2-thione, 5-butyl-5-pentyl-1,3-oxathiolane-2-thione, 5-butyl-5-hexyl-1,3-oxathiolane-2-thione, 5-pentyl-5-hexyl-1,3-oxathiolane-2-thione or 5-phenyl-1,3-oxathiolane-2-thione or mixtures thereof.

6. The process of claim 1 wherein the collector comprises 5-butyl-1,3-oxathiolane-2-thione, 5-pentyl-1,3-oxathiolane-2-thione or 5-hexyl-1,3-oxathiolane-2-thione or mixtures thereof.

7. The process of claim 1 wherein the sulfide ore is a copper sulfide.

8. The process of claim 1 wherein the 1,3-oxathiolane-2-thione corresponds to the formula

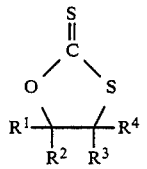

wherein $R^1$, $R^2$, $R^3$ and $R^4$ are separately in each occurrence hydrogen, a hydrocarbyl group or a hydrocarbyl group substituted with a halo, carbonylalkoxy, alkoxy, sulfide, mercapto, cyano, hydroxyl or nitro group.

9. The process of claim 8 wherein $R^1$, $R^2$, $R^3$ and $R^4$ are separately in each occurrence $C_{1-20}$ hydrocarbyl or hydrogen.

10. The process of claim 9 wherein $R^1$ is $C_{1-20}$ alkyl or $C_{1-20}$ aryl, and $R^2$, $R^3$ and $R^4$ is hydrogen.

11. The process of claim 10 wherein $R^1$ is $C_{2-10}$ alkyl.

12. The process of claim 11 wherein $R^1$ is $C_{4-6}$ alkyl.

* * * * *

UNITED STATES PATENT AND TRADEMARK OFFICE

CERTIFICATE OF CORRECTION

PATENT NO. : 4,511,464

DATED : April 16, 1985

INVENTOR(S) : Roger W. Bergman

It is certified that error appears in the above-identified patent and that said Letters Patent is hereby corrected as shown below:

Column 3, line 44, entire line should read -- In the above formula $R^1$ is preferably $C_{1-20}$ hydro- --.

Column 3, line 45, "$R_1$" should read -- $R^1$ --.

Column 7, line 46, the word "invention" should be followed with a period, as in -- invention. --.

Column 10, line 21, "oxathiolane-2thione," should read -- oxathiolane-2-thione, --.

Signed and Sealed this

Tenth Day of September 1985

[SEAL]

*Attest:*

DONALD J. QUIGG

*Attesting Officer* *Acting Commissioner of Patents and Trademarks - Designate*